US005415003A

United States Patent [19]

Bertva et al.

[11] Patent Number: 5,415,003

[45] Date of Patent: May 16, 1995

[54] METHOD FOR REMOVING ORIGINAL TYPE LUBRICANT FROM AIR CONDITIONING SYSTEM AND INJECTING REPLACEMENT OIL

[76] Inventors: John T. Bertva, 4009 Southwood East, Colleyville, Tex. 76034; Danny A. Wheeler, 1200 Nicole, #1508, Fort Worth, Tex. 76120

[21] Appl. No.: 227,441

[22] Filed: Apr. 14, 1994

[51] Int. Cl.[6] ..... F25B 47/00

[52] U.S. Cl. ..... 62/85; 62/303; 62/77

[58] Field of Search ..... 62/84, 85, 292, 303, 62/475

[56] References Cited

U.S. PATENT DOCUMENTS 4,934,390 6/1990 Sapp ..... 62/303

5,231,843 8/1993 Keltner ..... 62/303

*Primary Examiner*—John M. Sollecito

[57] ABSTRACT

A method for recovering original type oil from a system that has been charged with an original type refrigerant eliminates the need for removing and cleaning individual components. A separate oil separator is connected to the compressor suction of the air conditioning system. The air conditioning system is operated to collect oil in the oil separator. Then the oil separator is bypassed and the system is injected with a replacement oil. The system is again operated, with the replacement oil mixing with the original type oil. The oil separator is again reconnected into the system at the suction port of the compressor. The air conditioning system operates again, with the oil being collected a second time. The system is then ready for recovery of refrigerant by a recovery unit.

11 Claims, 3 Drawing Sheets

METHOD FOR REMOVING ORIGINAL TYPE LUBRICANT FROM AIR CONDITIONING SYSTEM AND INJECTING REPLACEMENT OIL

BACKGROUND OF THE INVENTION

1. Field of the invention

This invention relates in general to performing maintenance on air conditioning systems, and in particular to a method for removing lubricant from an air conditioning system that is to be changed from one type of refrigerant to another, the original lubricant being incompatible with the replacement refrigerant.

2. Description of the Prior Art

A transition is under way from one type of refrigerant to another type of refrigerant for air conditioning systems. The first type of refrigerant has been found harmful to the ozone layer, and is being phased out. A replacement refrigerant has been developed which is less harmful to the environment. For example, a common refrigerant that is being phased out is CFC-12, and it is being replaced by HFC-134a. As CFC-12 becomes scarce and expensive, millions of air conditioning systems will need to be converted to use HFC-134a when maintenance is required on the air conditioning system.

The two refrigerants are incompatible, as well as the oil used with them. CFC-12 uses a mineral oil as a lubricant for the compressor. The mineral oil carries chlorine from the CFC-12, thus must be removed from the system. Preferably, it should be removed down to one percent or less. Moreover, mineral oil is not a recommended or desirable oil to use with HFC-134a refrigerant.

Recovery systems are widely used now for recovering refrigerant from air conditioning systems to avoid discharge into the atmosphere. A typical recovery system has high and low pressure hoses that will tap into the air conditioning system on the high and low pressure sides of the compressor. A filter screens debris as refrigerant flows into the recovery unit. A recovery unit expansion valve and evaporator convert any liquid components to a gas. A recovery compressor compresses the refrigerant, and passes it through a receiver-drier and oil separator to a condenser. The gaseous refrigerant is condensed to a cooler liquid and placed in a storage container. The filter and receiver-drier clean the refrigerant as it passes to the storage container.

Charging units are also available for charging refrigerant into air conditioning systems. These charging systems may be stand alone or they may be incorporated with the recovery unit. A vacuum pump will be employed to evacuate the air conditioning system to a selected level after the refrigerant has been first recovered. Then the pressure difference will cause refrigerant to flow from the recovery unit storage unit, or another storage container, into the evacuated system.

In the prior art, the amount of oil removed from the air conditioning system by the recovery unit is reintroduced when recharging the systems. An oil injector is employed for the reintroduction. One type of oil injector has a line that will tap into the air conditioning system. Another line leads from the base of the oil injector to an output line of the storage container. Pressure from the storage container will apply pressure to the injector to force the lubricant into the air conditioning system.

Some oil will be recovered by the recovery unit oil separator, however considerable portions will remain in the air conditioning system. The recovery unit oil separator separates oil only due to oil droplets mixed in the refrigerant flowing as a result of the suction pressure of the recovery compressor. Also, the vacuum pump will not evacuate oil from the air conditioning system. Residual amounts will remain.

While existing recovery units adequately recover some of the oil and substantially all of the refrigerant, existing units do not have provisions for recovering the lubricant to a one percent level or less. As a result, a mechanic must remove the major components of the air conditioning system and separately clean them, in order to reach the desired level. This is a time consuming process.

SUMMARY OF THE INVENTION

In this invention, a recovery unit will first be connected to the air conditioning system to recover refrigerant conventionally. Most of the original lubricant will remain in the system after recovery. Then, the suction line leading between the system evaporator and system compressor is disconnected. A service line has one end connected to the system compressor, and another service line has one end connected to the evaporator line. These service lines have a quick disconnect fittings on the opposite ends incorporating a check valve so that the service lines can be disconnected and reconnected to each other while the air conditioning system remains under pressure.

After the service lines are connected to each other, an operating refrigerant is charged into the air conditioning system conventionally. The system will be operated a few minutes to distribute original type oil remaining within the system into the operating refrigerant. Then an oil separator is connected to the quick disconnect fittings so that operating refrigerant in the system must flow through the oil separator. The air conditioning system is then operated, so that the oil separator will collect original type oil as the operating refrigerant flows through the air conditioning system during its normal operation.

After collecting oil, the original type oil is drained from the separator. An amount of replacement type oil equal to the amount of original type oil is charged into the system using an oil injector of a conventional type. The replacement type oil is compatible with the replacement refrigerant desired. The system will be operated a few minutes with the quick disconnect fittings connected to each other, bypassing the oil separator, to mix the replacement type oil with the original type oil. Then, the oil separator is placed back again in line between the system evaporator and compressor. The system is operated again, with the oil separator collecting the mixed original and replacement type oil. Substantially all of the original type oil will be removed by the end of this step.

The recovery unit will now be employed to recover the operating refrigerant from the air conditioning system. Maintenance may then be performed and the replacement refrigerant and replacement oil reintroduced.

DETAILED DESCRIPTION OF THE INVENTION

Figure 1:
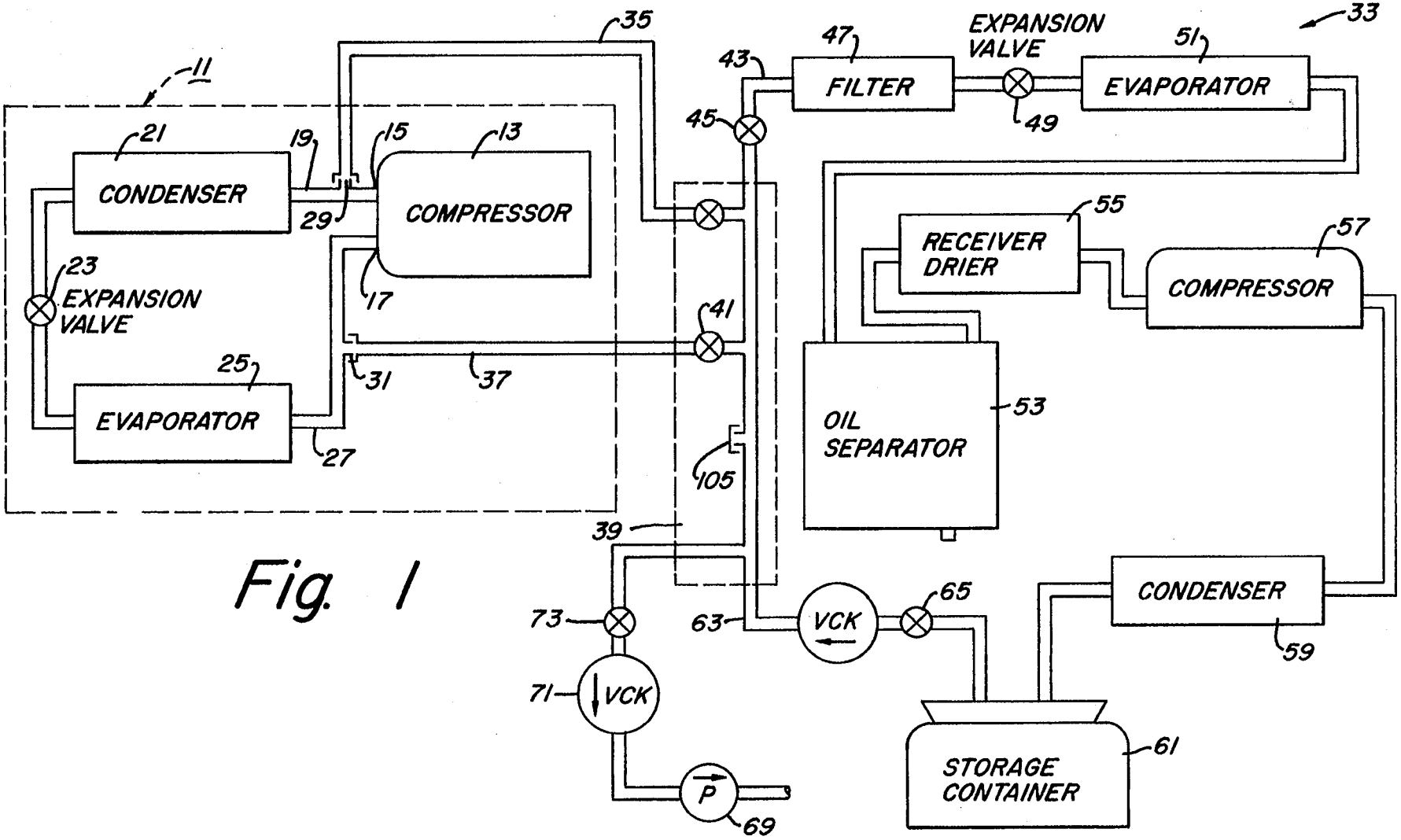
FIG. 1 is a schematic illustrating a conventional air conditioning system connected to a conventional recovery unit to illustrate several steps of the method according to this invention.

Referring to FIG. 1, the dotted lines illustrate major components of a conventional air conditioning system 11. Air conditioning system 11 has a compressor 13 which has a discharge port 15 and a suction port 17, each of which include threaded fittings. A condenser line 19 secures to the discharge port 15, connecting the compressor 13 to condenser 21. Condenser 21 is connected to an expansion valve 23, which leads to an evaporator 25. Evaporator 25 has an evaporator line 27 that connects to suction port 17 of compressor 13.

A high pressure service port 29 is located in condenser line 19, and a low pressure service port 31 is located in evaporator line 27 Ports 29, 31 are of a quick disconnect, check valve type to enable connection and disconnection of a recovery unit 33 while the lines 19, 27 are under pressure.

The major components of a recovery unit 33 are shown connected to air conditioning 11 for recovering refrigerant. Recovery unit 33 has a high pressure hose 35 that connects to high pressure service port 29 and a low pressure hose 37 that connects to low pressure service port 31. Hoses 35, 37 lead to a manifold 39, shown by the dotted lines. Hoses 35, 37 may be connected while the air conditioning system 11 is under pressure.

Manifold 39 has a valve 41 for each hose 35, 37. An intake line 43 connects to manifold 39 for receiving refrigerant flowing through hoses 35, 37 when valves 41 are open. Intake line 43 has a valve 45, typically solenoid operated, which leads to a filter 47. Filter 47 is a screen filter for filtering debris that may be contained in the refrigerant.

Filter 47 connects to an expansion valve 49 which will expand the refrigerant, dropping the pressure. The refrigerant converts to a cold gas and flows to an evaporator 51. Evaporator 51 adds heat to the gaseous refrigerant. The refrigerant flows from an evaporator 51 to an oil separator 53. Oil separator 53 is a canister which will collect droplets of oil contained in the refrigerant. Oil separator 53 connects to another filter, which is receiver-drier 55. Receiver-drier 55 removes contaminants from the refrigerant, including water moisture.

Receiver-drier 55 leads to a compressor 57, which compresses the clean, low pressure gaseous refrigerant to a high pressure gas. The output of compressor 57 leads to a condenser 59 which condenses the gaseous refrigerant into a liquid. The liquid refrigerant flows into a storage container 61.

Storage container 61 preferably has an outlet line 63 which leads back to manifold 39. A solenoid valve 65 and a check valve 67 are contained in outlet line 63 to selectively allow the flow of refrigerant out of storage container 61. Outlet line 63 begins near the bottom of storage container 61 where liquid will normally be present. Recovery unit 33 also preferably has a vacuum pump 69 connected to manifold 39 for use in recharging. Vacuum pump 69 has a valve 73, preferably solenoid actuated, and a check valve 71.

The first step in the method of this invention is to recover the original type CFC-12 refrigerant. When connected as shown in FIG. 1 to recover refrigerant, air conditioning system 11 will not be operating. Recovery unit compressor 57 will operate, drawing system original type refrigerant through hoses 35, 37. The refrigerant flows through intake line 43, has oil droplets removed by oil separator 53, is cleaned by filter 47 and receiver-drier 55, and stored in storage container 61. Although the original type refrigerant has been recovered by this step, a significant amount of oil will still remain in air conditioning system 11. This original type oil is not recommended for use with the replacement refrigerant HFC-134a to be later charged into system 11.

Figure 2:
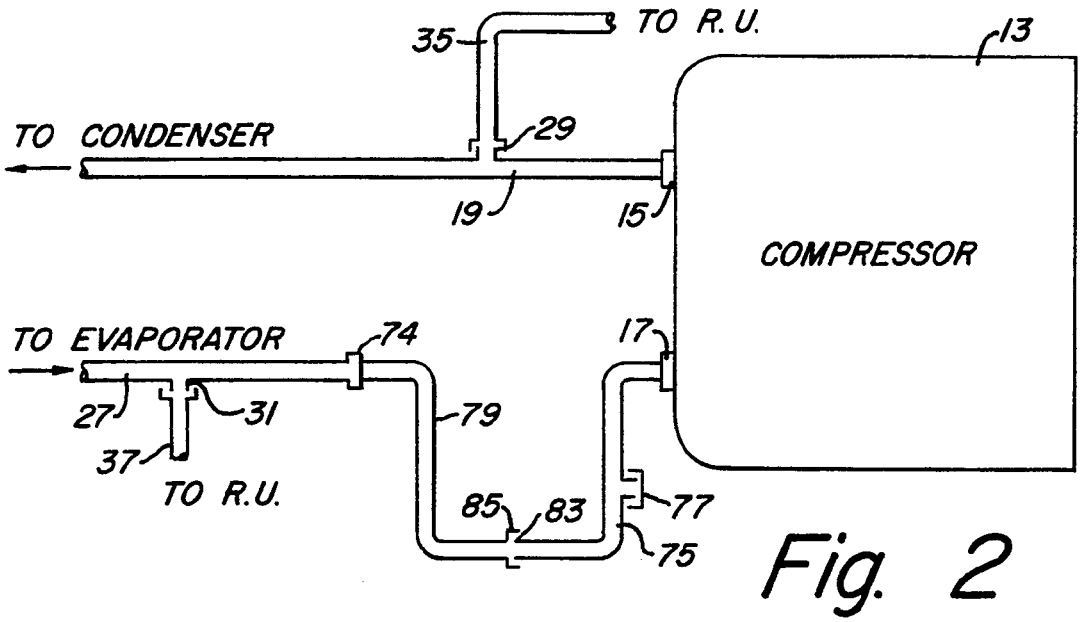
FIG. 2 is a schematic that illustrates quick disconnect service lines connected between the evaporator and compressor of the system, as one of the steps of the method of this invention.

FIG. 2 illustrates the next step. Once the original type refrigerant CFC-12 has been recovered from air conditioning system 11, the evaporator line 27 is disconnected from compressor suction port 17 by unscrewing threaded fitting 74. Then, a first service line 75 is connected to the threads of suction port 17. Service line 75 has an inject port 77 which will be explained subsequently. A second service line 79 is connected to the evaporator fitting 74. Service lines 79, 75 have mating quick disconnect fittings 83, 85. Fittings 83, 85 are of a conventional type that employ a check valve so that they may be later quickly disconnected and connected while maintaining pressure within the service lines 75, 79. At this point, however, there will be no pressure in service lines 75, 79 because of the prior recovery of original type refrigerant from the system 11.

The fittings 83, 85 are then connected to each other as shown in FIG. 2, and the air conditioning system 11 will be recharged with an operating refrigerant. The operating refrigerant would normally be the previously recovered original type, CFC-12, but it also could be a different type. It is recharged conventionally. Referring to FIG. 1, this is handled by first operating vacuum pump 69 while valves 45 and 65 are closed and valves 41 open. Vacuum pump 69 will draw the system 11 to a desired low level. Once the low level has been reached, valve 73 is closed and valve 65 will be opened. Refrigerant will flow from storage container 61 into the air conditioning system 11 until a desired pressure level is reached.

In the prior art, normally a measured amount of oil is injected into the system after recharging to replace the oil that was recovered by the recovery unit. However, in the method of this invention, replacement oil need not be injected at this point. After recharging, the air conditioning system 11 is operated for a selected time, about ten minutes, to cause the remaining original type oil to mix with the operating refrigerant. If the system 11 is for a motor vehicle, the engine will running about 2000 rpm. The recovery unit 33 may remain passively connected to the air conditioning system 11 while the system 11 is operating, but valves 41 or valves 43, 65 will be closed.

Figure 3:
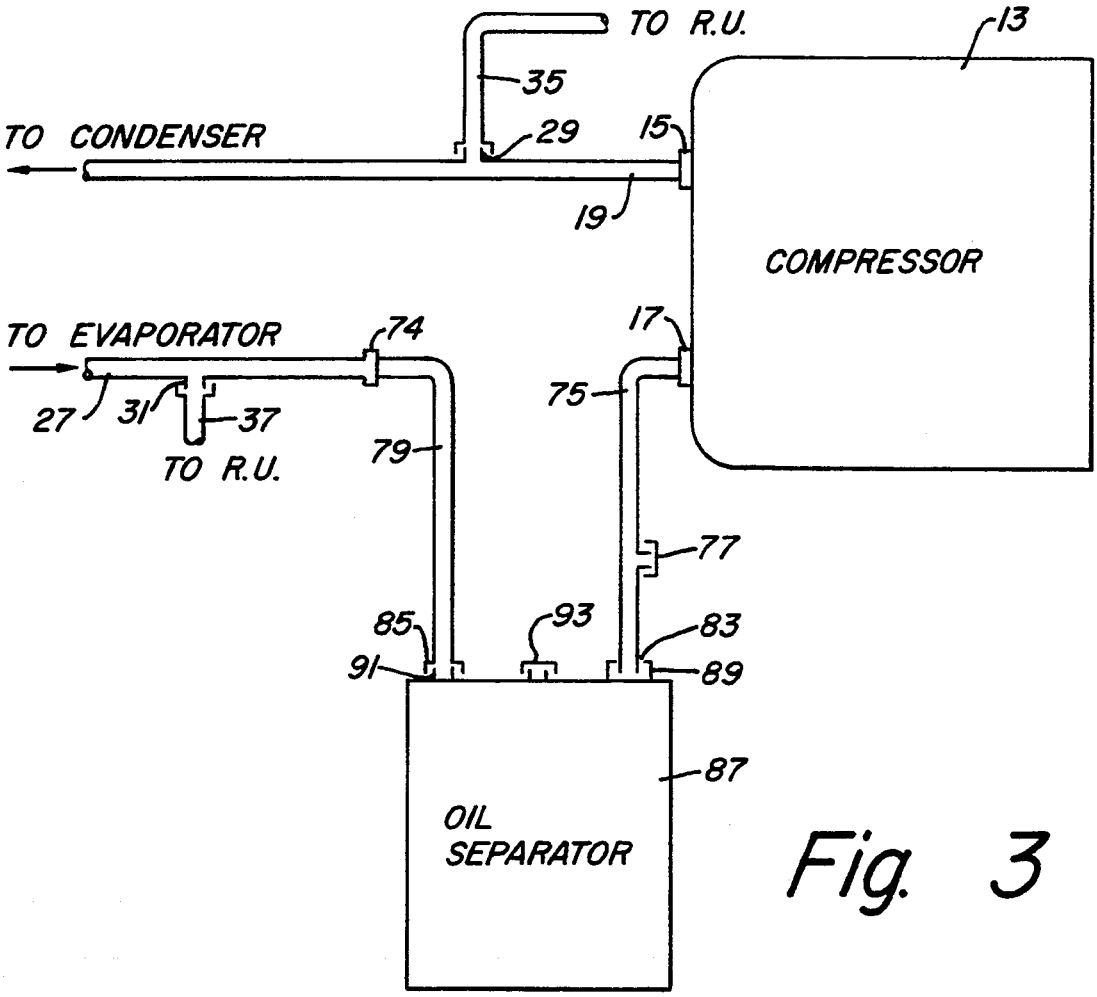
FIG. 3 is a schematic that illustrates connecting the quick disconnect service lines to an oil separator to recover original type oil from the air conditioning system as it operates, this being a further step of the method of this invention.

Then, the quick disconnect fittings 83, 85 as shown in FIG. 2 are disconnected from each other and connected to an oil separator 87, shown in FIG. 3, which is previously evacuated. Oil separator 87 is similar to the recovery unit oil separator 53. It basically is a container having internal baffles and external fittings 89, 91. Fittings 89, 91 connect respectively to the quick disconnect fittings 83, 85. The connections of the service lines 75, 79 to oil separator 87 are made while pressure exists in the service lines 75, 79 due to the existing pressure in the air conditioning system 11. Oil separator 87 also has an external evacuate fitting 93. It is preferably of the same size and type as the service ports 29, 31.

While configured as shown in FIG. 3, the air conditioning system 11 will again be operated conventionally. Compressor 13 will be operated for a time period such as around five minutes, with the engine at idle. Operating refrigerant in system 11 must flow through oil separator 87 while flowing from evaporator 25 to compressor 13. Original type oil contained in the air conditioning system 11 will collect in the oil separator 87. The high and low pressure hoses 35, 37 may remain passively connected to the recovery unit 33 (FIG. 1), but valves 41 or 45, 65 will be closed and recovery unit 33 not operating during this process.

Figure 4:
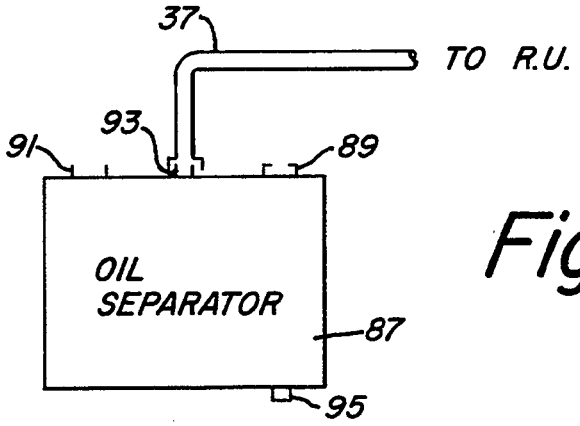
FIG. 4 is a schematic that illustrates recovering refrigerant and draining original type oil from the oil separator of FIG. 3 after completion of the step of FIG. 3.

Following this step, the service lines 75, 79 are reconnected to each other with fittings 83, 85 as shown in FIG. 2. The original type oil is removed from oil separator 87 and measured. This is handled by connecting one of the recovery unit hoses 35, 37 to oil separator 87. As illustrated generally in FIG. 4, the low pressure hose 37 is shown removed from the low pressure fitting 31 and connected to the oil separator evacuate fitting 93. The refrigerant contained in the oil separator 87 will then be removed by operating recovery unit 33 conventionally. This will also relieve the pressure on oil separator 87. Then, the oil is drained from drain 95 of oil separator 87 and measured.

Figure 5:
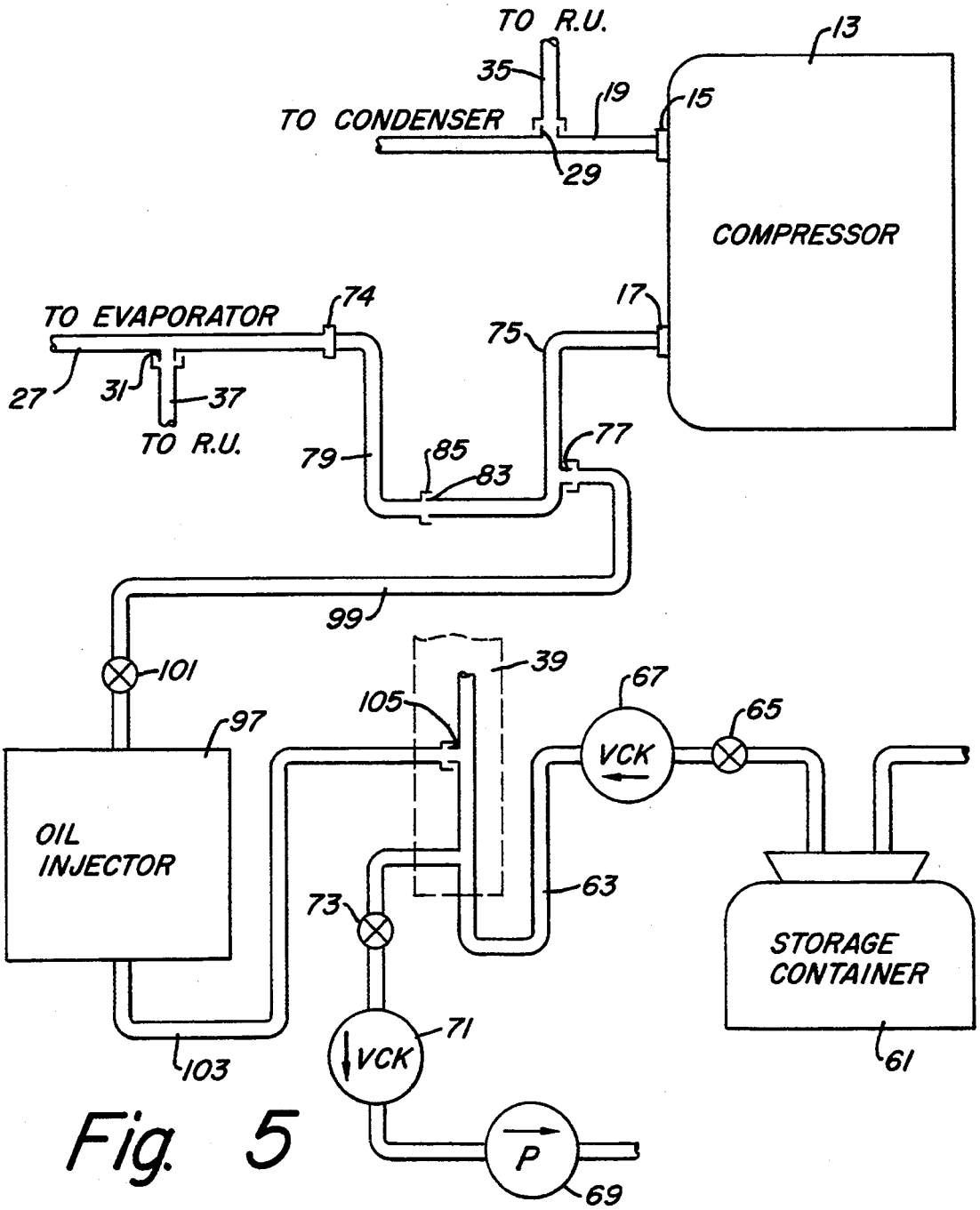
FIG. 5 is a schematic illustrating injecting a replacement type oil into the air conditioning system to perform one of the steps of the method of this invention.

At this point, the air conditioning system 11 will still be charged with the operating refrigerant, but it is short of oil due to the original type oil collected by oil separator 87. Replacement type oil is then injected into the air conditioning system 11 in an amount equal to the original type oil drained previously from oil separator 87. The replacement type oil is of a type that will be compatible with the replacement refrigerant HFC-134a. The replacement oil is injected conventionally, and FIG. 5 illustrates how this may be handled.

Oil injector 97 is conventional, comprising a chamber for receiving lubricant. It has an output line 99 on one side of the chamber that will connect to inject port 77 contained in the service line 75. A valve 101 opens and closes line 99. A pressure line 103 extends from the other end of oil injector 97, on the other side of the chamber. Pressure line 103 is preferably connected to a service port 105 in manifold 39. Service port 105 is connected into the output line 63.

The injection hose 99 will be connected to inject port 77 and pressure line 103 connected to service port 105 with valve 101 closed. Vacuum pump 69 is then operated with valves 41, 45 (FIG. 1) and 65 closed and valve 73 open. Injection hose 99 is then purged of air by momentarily opening the valve 101 to draw a vacuum in hose 99, then closing it.

The vacuum pump 69 is turned off, hose 103 disconnected and an amount of replacement oil, equal to the amount drained from separator 87, is added to the chamber of injector 97. Vacuum pump 69 is again operated momentarily with valves 45 (FIG. 1) and 65 closed and valve 73 open to evacuate the small amount of air located above the level of replacement oil in injector 97. Then, vacuum pump 69 is turned off and the air conditioning system 11 is operated. Recovery compressor 57 will not be operating. Valve 65 (FIG. 1) will be opened to allow refrigerant to flow from storage container 61, through output line 63, out service port 105 and to pressure line 103. The refrigerant from storage container 61 applies pressure to the oil injector 97 to force lubricant out through injection hose 99. Valve 101 will be opened to allow replacement type oil to flow through injection line 99, service port 77 and into compressor suction port 17. The air conditioning system 11 will then be operated for about ten minutes with the engine at 2000 rpm. After the replacement type oil has been completely injected into air conditioning system 11, valve 101 is closed and line 99 disconnected from injection port 77. The operating refrigerant in the oil injector 97 is recovered conventionally with recovery unit 33. This is handled by closing valve 65, opening valve 45 and operating recovery compressor 57.

The air conditioning system 11 is then stopped and the oil separator 87 (FIG. 3) is connected back between compressor 13 and evaporator 25. This is handled by disconnecting the fittings 83, 85 from each other, as shown in FIG. 2, and connecting them to fittings 89, 91 as shown in FIG. 3. The air conditioning system 11 is then started again and operated for about five minutes at engine idle to again recover oil. The oil recovered now will be replacement oil mixed with residual amounts of the original oil. This mixed oil is removed from separator 87 in the same manner as previously described. The service lines 75, 79 are disconnected from evaporator line fitting 74 and suction port 17, and evaporator line fitting 74 is reconnected to suction port 17.

At this point, the air conditioning system 11 is substantially free of the original type oil. It is ready for maintenance and conversion over the replacement type refrigerant. The next step would be to recover the operating refrigerant from system 11 using recovery unit 33 in the manner previously described. Then, certain components will likely need to be changed for retrofitting the air conditioning system 11. Once retrofitted, the system will be recharged with replacement type refrigerant and replacement oil.

The invention has significant advantages. It provides a means of effectively removing nearly all of the original type oil in an air conditioning system without removing and separately cleaning major components. It provides a more cost effective manner in which an air conditioning system can be converted from CFC-12 to HFC-134a refrigerant. The new system requires few additional components to currently existing recovery, charge, and inject equipment.

While the invention has been shown in only one of its forms, it should be apparent to those skilled in the art that it is not so limited, but is susceptible to various changes without departing from the scope of the invention.

We claim:

1. A method for recovering original type oil from an air conditioning system that has been previously charged with an original type refrigerant and is to be converted for operation with a replacement refrigerant, the method comprising:

connecting an oil separator into the air conditioning system;

operating the air conditioning system with an operating refrigerant and collecting original type oil in the oil separator to remove a substantial portion of the original type oil from the air conditioning system while the air conditioning system operates; then removing the original type oil from the oil separator; then injecting into the air conditioning system a replacement type oil that is compatible with the desired replacement refrigerant; then operating the air conditioning system with the operating refrigerant and the replacement type oil and collecting in the oil separator the replacement type oil mixed with residual amounts of original type oil; then removing the replacement type oil and original type oil from the oil separator and recovering the operating refrigerant from the air conditioning system.

2. The method according to claim 1 wherein the step of connecting an oil separator into the air conditioning system comprises connecting the oil separator between a system compressor and a system evaporator.

3. The method according to claim 1 wherein the step of connecting an oil separator into the air conditioning system comprises:

recovering the original type refrigerant previously charged in the system; then disconnecting within the system a system line from a system fitting through which refrigerant normally flows when the system is operating; then connecting a first quick disconnect service line to the system fitting, a second quick disconnect service line to the system line, and communicating opposite ends of the service lines to each other to provide a passage between the system line and a system fitting; then charging the system with the operating refrigerant; then communicating the oil separator with the service lines to require flow from the system line to the system fitting to pass through the oil separator.

4. The method according to claim 1 wherein the step of connecting an oil separator into the air conditioning system comprises:

recovering the original type refrigerant previously charged in the system; then disconnecting within the system a system line from a system fitting through which refrigerant normally flows when the system is operating; then connecting a first quick disconnect service line to the system fitting, a second quick disconnect service line to the system line, and connecting opposite ends of the service lines to each other to provide a passage between the system line and the system fitting; then charging the air conditioning system with the operating refrigerant; then disconnecting the service lines from each other and connecting the oil separator to the opposite ends of the service lines to require flow from the system line to the system fitting to pass through the oil separator.

5. The method according to claim 1 wherein the step of connecting an oil separator into the air conditioning system comprises:

recovering the original type refrigerant previously charged in the system; then disconnecting a system evaporator line from a suction port of a system compressor; then connecting a first quick disconnect service line to the suction port of the system compressor, a second quick disconnect service line to the system evaporator line, and connecting opposite ends of the service lines to each other to provide a passage between the system compressor and a system evaporator; then charging the system with the operating refrigerant; then disconnecting the service lines from each other and connecting the oil separator to the opposite ends of the service lines to require flow from the system evaporator to the system compressor to pass through the oil separator.

6. The method according to claim 1 wherein the step of connecting an oil separator into the air conditioning system comprises:

recovering the original type refrigerant previously charged in the system; then disconnecting within the system a system line from a system fitting through which refrigerant flows when the system is operating; then connecting a first quick disconnect service line to the system fitting, a second quick disconnect service line to the system line, and communicating opposite ends of the service lines to each other to provide a passage between the system line and a system fitting; then charging the system with the operating refrigerant; then operating the system for a selected time period to mix original type oil remaining in the system with the operating refrigerant; then communicating the oil separator with the service lines to require flow from the system line to the system fitting to pass through the oil separator.

7. The method according to claim 1 wherein the steps of recovering the operating refrigerant from the air conditioning system comprises:

providing a recovery unit having a recovery expansion valve, a recovery evaporator, a recovery compressor, a recovery condenser, and a storage container;

connecting the recovery unit to the system; and operating the recovery compressor to draw the operating refrigerant through the recovery expansion valve, recovery evaporator, recovery compressor and recovery condenser into the storage container.

8. A method for recovering original type oil from an air conditioning system that has been previously charged with an original type refrigerant and is to be converted for operation with a replacement refrigerant, the method comprising:

recovering the original type refrigerant from the system with a recovery unit, but leaving a substantial portion of the original type oil in the system; then connecting a service line between a system evaporator and a system compressor of the system; then charging the system with an operating refrigerant; then providing an oil separator and placing it in communication with the service line a first time so that flow of operating refrigerant from the system evaporator to the system compressor passes through the oil separator; and operating the system and collecting original type oil in the oil separator to remove a substantial portion but not all of the original type oil from the system while the system operates; then stopping operation of the system, placing the oil separator out of communication with the service line, and removing the original type oil from the oil separator; then injecting into the system a replacement type oil that is compatible with the replacement refrigerant; then placing the oil separator in communication with the service line a second time; and operating the system with the operating refrigerant and collecting in the oil separator the replacement type oil mixed with residual amounts of original type oil; then recovering the operating refrigerant from the system with the recovery unit and removing the oil separator and the service line from the system.

9. The method according to claim 8 further comprising the step of operating the system with the operating refrigerant for a selected time before communicating the oil separator with the service line a first time.

10. The method according to claim 8 further comprising the step of operating the system a first time with the operating refrigerant for a selected time before communicating the oil separator with the service line a first time; and operating the system a second time with the operating refrigerant for a selected time before communicating the oil separator with the service line a second time.

11. A method for recovering original type oil from an air conditioning system that has been previously charged with an original type refrigerant and is to be recharged with a desired replacement refrigerant, the method comprising:

recovering the original type refrigerant previously charged in the system with a recovery unit; then disconnecting a system evaporator line from a suction port of a system compressor; then connecting a first quick disconnect service line to the suction port of the system compressor, a second quick disconnect service line to the system evaporator line, and connecting opposite ends of the service lines to each other to provide a passage between the system compressor and a system evaporator; then charging the system with operating refrigerant and operating the system for a selected time; then disconnecting the service lines from each other and connecting an oil separator to the opposite ends of the service lines to require refrigerant flow from the system evaporator to the system compressor to pass through the oil separator; then operating the system and collecting original type oil in the oil separator to remove a substantial portion of the original type oil from the system while the system operates; then removing the oil separator from the service lines and draining the original type oil from the oil separator; and reconnecting the opposite ends of the service lines to each other; then injecting into the system while the system is operating a replacement type oil that is compatible with the replacement refrigerant; then reconnecting the oil separator to the service lines; and operating the system with the operating refrigerant and the replacement type oil and collecting in the oil separator the replacement type oil mixed with residual original type oil; then recovering the operating refrigerant with the recovery unit; then removing the oil separator and the service lines from the system.

* * * * *